US009933147B2

(12) United States Patent
Wang et al.

(10) Patent No.: US 9,933,147 B2
(45) Date of Patent: Apr. 3, 2018

(54) TERMINAL BLOCK ASSEMBLY

(71) Applicant: LITE-ON TECHNOLOGY CORP., Taipei (TW)

(72) Inventors: Shih-Chang Wang, Taipei (TW); Pin-Hao Hsu, Taipei (TW); Hamid Kashani, Taipei (TW)

(73) Assignee: LITE-ON TECHNOLOGY CORP., Taipei (TW)

( * ) Notice: Subject to any disclaimer, the term of this patent is extended or adjusted under 35 U.S.C. 154(b) by 50 days.

(21) Appl. No.: 15/080,957

(22) Filed: Mar. 25, 2016

(65) Prior Publication Data

US 2017/0276341 A1 Sep. 28, 2017

(51) Int. Cl.

| | |
|---|---|
| ***F21V 31/03*** | (2006.01) |
| ***F21V 25/10*** | (2006.01) |
| ***F21V 23/06*** | (2006.01) |
| ***F21V 31/00*** | (2006.01) |
| *F21W 131/10* | (2006.01) |

(52) U.S. Cl.

CPC ..... *F21V 25/10* (2013.01); *F21V 23/06* (2013.01); *F21V 31/005* (2013.01); *F21W 2131/10* (2013.01)

(58) Field of Classification Search

CPC ..... F21V 25/10; F21V 23/06; F21V 31/05; F21V 2131/10

USPC ..... 362/362; 174/559

See application file for complete search history.

(56) References Cited

U.S. PATENT DOCUMENTS

| | | | | |
|---|---|---|---|---|
| 9,306,379 | B2 * | 4/2016 | Greenberg | H02G 3/08 |
| 2014/0305693 | A1 * | 10/2014 | Greenberg | H02G 3/08 174/559 |
| 2016/0079687 | A1 * | 3/2016 | Holland | H01H 31/125 439/797 |

* cited by examiner

*Primary Examiner* — Karl D Frech

(74) *Attorney, Agent, or Firm* — Burris Law, PLLC

(57) ABSTRACT

A terminal block assembly includes a block housing, a surge protection device, a plurality of cable-receiving seats, a plurality of connector sets and a first fuse. The block housing defines an accommodating space that confines the surge protection device. The cable-receiving seats and the connector sets are mounted on the block housing. Each of the connector sets includes at least one first connector that is electrically connected to a light-emitting module of an outdoor lamp, and a second connector that extends into the accommodating space and that is electrically connected to the surge protection device. The first fuse is mounted to the block housing, and is electrically connected to the surge protection device.

16 Claims, 8 Drawing Sheets

TERMINAL BLOCK ASSEMBLY

FIELD

The disclosure relates to a terminal block, more particularly to a terminal block assembly incorporating a fuse and a surge protection device.

BACKGROUND

In general, outdoor lamps in the United States oftentimes include a lamp casing, a light-emitting module, a terminal block that is disposed in the lamp casing and that is electrically connected to the light-emitting module and a plurality of power supply cables, a surge protection device that is disposed adjacent to the terminal block in the lamp casing and that is electrically connected to the terminal block to protect the light-emitting module against electrical surges caused by lightning, and a fuse that is disposed adjacent to the terminal block in the lamp casing and that is electrically connected to the terminal block. By virtue of the surge protection device and the fuse, damage due to lightning or a sudden electrical surge is effectively prevented.

However, since the terminal block, the surge protection device and the fuse are individual components of the outdoor lamp and are not incorporated into one assembly, a relatively large space is required for accommodating the above-mentioned components in the lamp casing and for placement of electrical wires that connect the above-mentioned components. Furthermore, the cost of installing the surge protection device and the fuse adds to the overall manufacturing cost of the outdoor lamp.

SUMMARY

Therefore, an object of the disclosure is to provide a terminal block assembly that can alleviate at least one of the aforesaid drawbacks of the prior art.

According to the disclosure, the terminal block assembly is used in an outdoor lamp that includes a light-emitting module, and is connected to a plurality of electrical cables. The terminal block assembly includes a block housing, a surge protection device, a plurality of cable-receiving seats, a plurality of connector sets and a first fuse.

The block housing defines an accommodating space. The surge protection device is confined in the accommodating space. The cable-receiving seats are mounted on the block housing for receiving the electrical cables, respectively. The connector sets are mounted on the block housing. Each of the connector sets includes at least one first connector that is electrically connected to the light-emitting module, and a second connector that extends into the accommodating space and that is electrically connected to the surge protection device. The first fuse is mounted to the block housing, and is electrically connected to the surge protection device and a first selected one of the electrical cables.

BRIEF DESCRIPTION OF THE DRAWINGS

Other features and advantages of the disclosure will become apparent in the following detailed description of the exemplary embodiment with reference to the accompanying drawings, of which.

DETAILED DESCRIPTION

Figure 1:
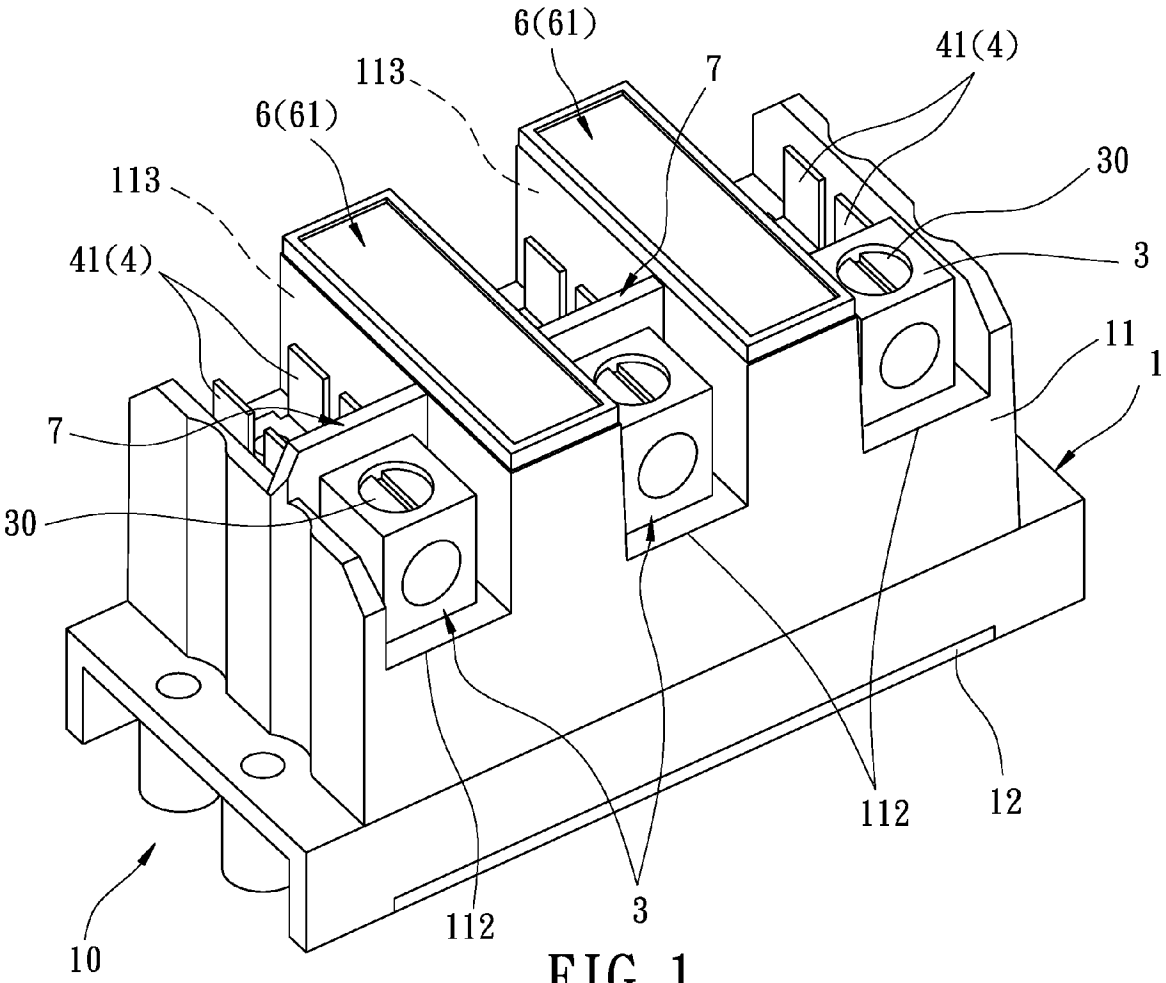
FIG. 1 is a perspective view illustrating a first exemplary embodiment of a terminal block assembly according to the disclosure.

Before the disclosure is described in greater detail, it should be noted that like elements are denoted by the same reference numerals throughout the disclosure.

Figure 2:
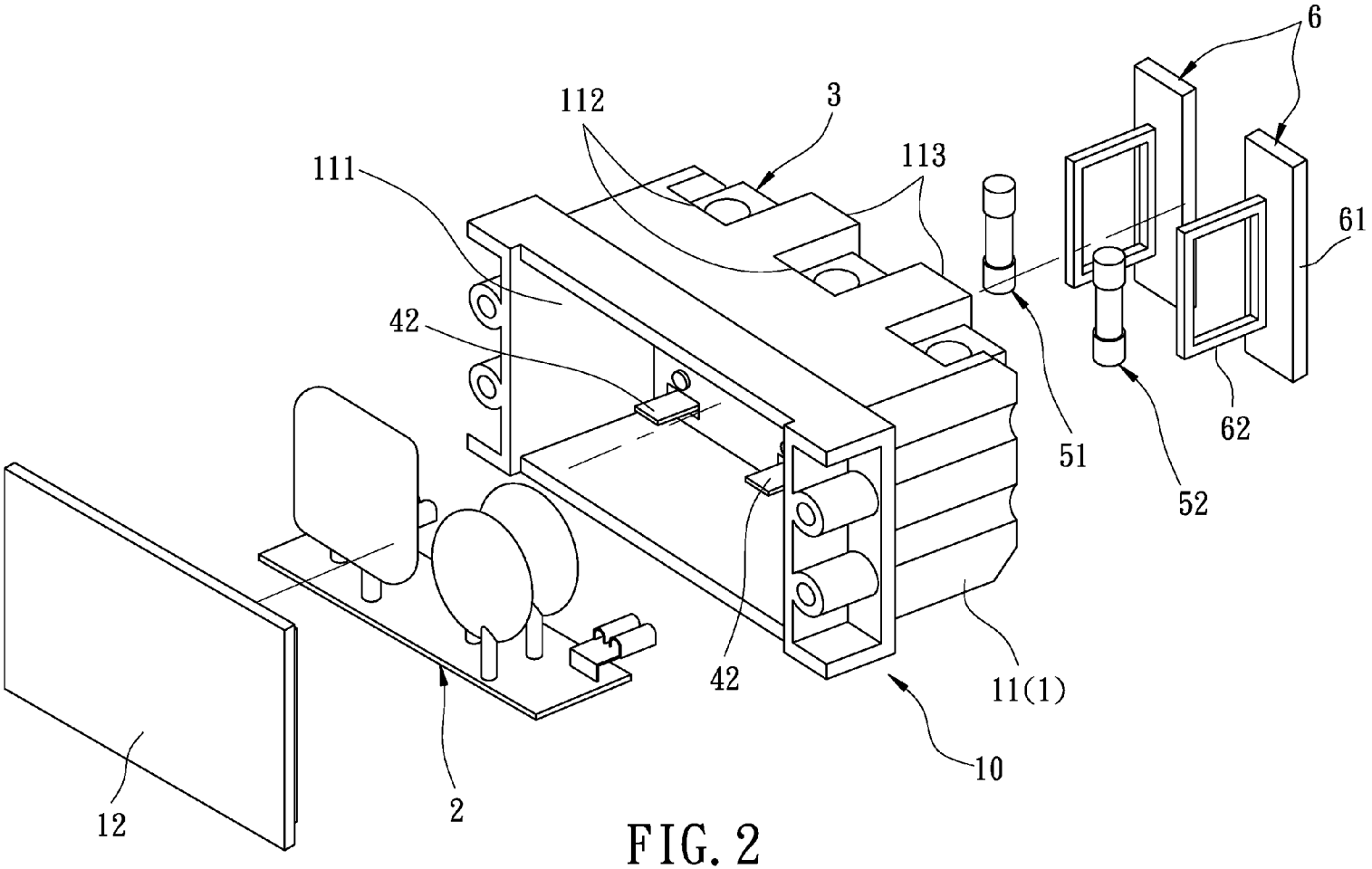
FIG. 2 is an exploded perspective view of the first exemplary embodiment.
Figure 3:
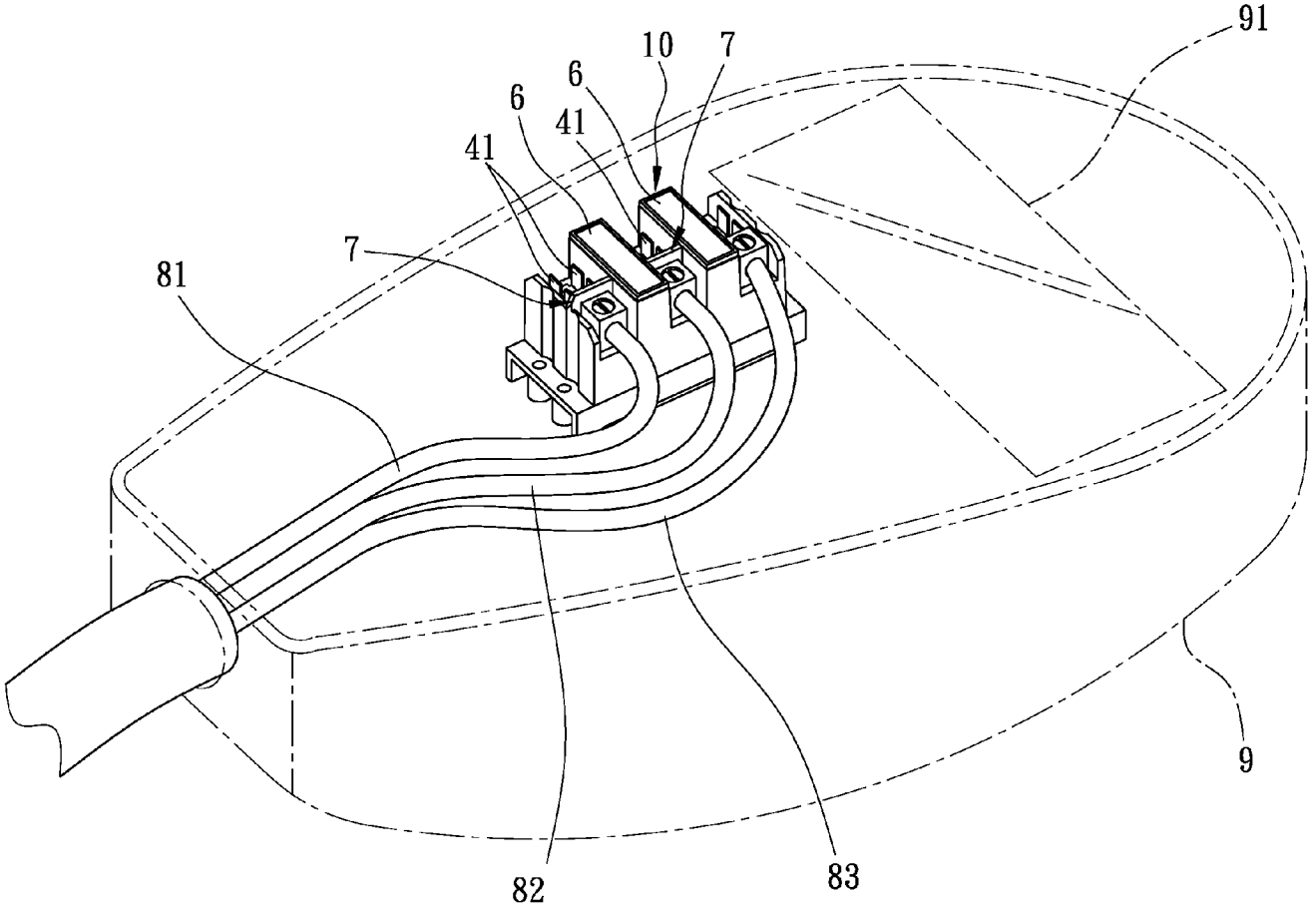
FIG. 3 is a fragmentary schematic view, illustrating the first exemplary embodiment being installed in an outdoor lamp and connected to three electrical cables.

Referring to FIGS. 1, 2 and 3, a first exemplary embodiment of a terminal block assembly 10 according to this disclosure is used in an outdoor lamp 9 (see FIG. 3) that includes a light-emitting module 91, and is connected to a plurality of electrical cables 81, 82, 83 for power supply (hereinafter referred to as live line 81, neutral 82 and ground 83). The terminal block assembly 10 includes a block housing 1, a surge protection device 2, three cable-receiving seats 3, three connector sets 4, a first fuse 51, a second fuse 52, two fuse holders 6 and two partitions 7.

The block housing 1 includes a housing body 11 and a cover board 12. The housing body 11 and the cover board 12 cooperatively define an accommodating space 111, and are sealed together so as to prevent water vapor from entering into the accommodating space 111. The housing body 11 has an outer surface that is formed with three spaced-apart grooves 112, and has two fuse-receiving portions 113. Each of the grooves 112 receives a respective one of the cable-receiving seats 3 and a respective one of the connector sets 4 therein. Each of the fuse-receiving portions 113 is configured as a slot that communicates spatially with the accommodating space 111, and permits a respective one of the first and second fuses 51, 52 to be mounted thereto. In this exemplary embodiment, the grooves 112 are arranged alternately with the fuse-receiving portions 113.

The surge protection device 2 is confined in the accommodating space 111. In this exemplary embodiment, the surge protection device 2 includes three metal oxide varistors (MOVs). Since the principle of how the surge protection device 2 functions is well-known to those skilled in the art, further detail of the same will not be provided herein for the sake of brevity. In other variations of this exemplary embodiment, the surge protection device 2 may include only one metal oxide varistor. It should be noted that in other examples, the surge protection device 2 is not limited to being MOVs, and may be selected from gas discharge tubes, spark gaps, etc., with no particular restriction.

The cable-receiving seats 3 are cubic in shape, are disposed in the respective grooves 112 of the housing body 11, and receive the electrical cables 81, 82, 83, respectively. The electrical cables 81, 82, 83 are fixedly and respectively disposed in the cable-receiving seats 3 by virtue of a plurality of set screws 30.

The connector sets 4 are disposed in the respective grooves 112. Each of the connector sets 4 is disposed adjacent to a corresponding one of the cable-receiving seats 3, and includes four first connectors 41 and a second connector 42. The first connectors 41 extend in a direction away from the accommodating space 111, and are for electrical connection to the light-emitting module 91. The second connector 42 extends into the accommodating space 111 and is electrically connected to the surge protection device 2.

The first fuse 51 is mounted in the respective one of the fuse-receiving portion 113 of the housing body 11, and is electrically connected to the surge protection device 2 and a first selected one of the electrical cables 81, 82, 83, e.g., the live line 81.

The second fuse 52 is mounted in the respective one of the fuse-receiving portion 113 of the housing body 11, and is electrically connected to the surge protection device 2 and a second selected one of the electrical cables 81, 82, 83, e.g., the neutral 82. In this exemplary embodiment, the first and second fuses 51, 52 are glass tube fuses. Alternatively, the first and second fuses 51, 52 may be blade type fuses or other type of fuses, with no particular restriction. Additionally, in this exemplary embodiment, the maximum current rating of the first and second fuses 51, 52 is, but not limited to, 10 amperes. In other variations of this exemplary embodiment, the maximum current rating of the first and second fuses 51, 52 may be 20 amperes.

The fuse holders 6 respectively engage the fuse-receiving portions 113 of the housing body 11. In greater detail, each of the fuse holders 6 includes a base board 61 and a holding frame 62 which is fixedly connected to one surface of the base board 61, and on which a respective one of the first and second fuses 51, 52 is securely disposed.

The partitions 7 are respectively disposed in selected ones of the grooves 112 which correspond in position to the live line 81 and the neutral 82, respectively. Each of the partitions 7 is disposed between and separates a corresponding one of the cable-receiving seats 3 and a corresponding one of the connector sets 4. In this exemplary embodiment, the partitions 7 and the housing body 11 are integrally formed.

Figure 4:
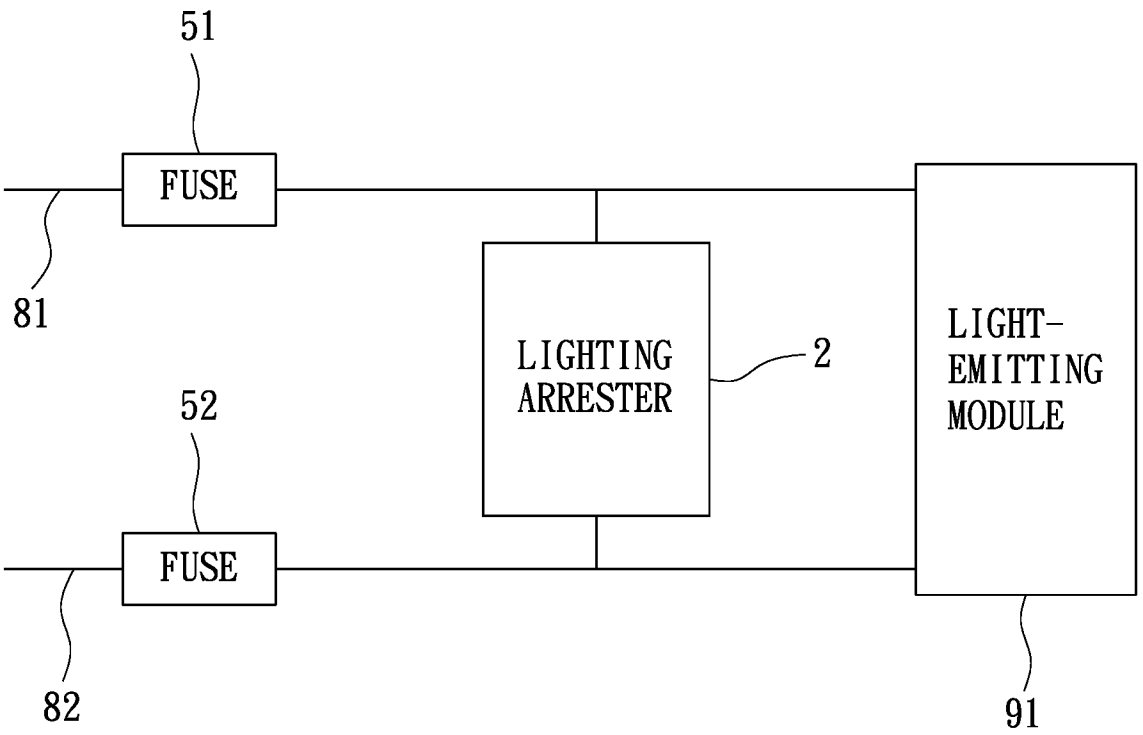
FIG. 4 is a schematic circuit block diagram illustrating two fuses and a surge protection device of the first exemplary embodiment being electrically connected to a light-emitting module.

Referring to FIGS. 3 and 4, when a lightning surge travels along the live line 81 and through the first fuse 51, most of the current of the lightning surge is diverted to the surge protection device 2. As a result, the light-emitting module 91 is prevented from damage due to the lightning surge. The first and second fuses 51, 52 serve as additional protection for protecting the light-emitting module 91. The partitions 7 are configured to ensure that the live line 81 and the neutral 82 do not contact the first connectors 41 or electric wires (not shown) connecting the first connectors 41 and the light-emitting module 91, so as to prevent occurrence of a short circuit which bypasses the first fuse 51 or the second fuse 52. The arrangement of the first and second fuses 51, 52 and the partitions 7 ensures that the lightning surge passes through one of the first and second fuses 51, 52 even if the live line 81 is incorrectly connected to the second fuse 52, and the neutral 82 is incorrectly connected to the second fuse 52.

It should be noted that the number of the cable-receiving seats 3, of the connector sets 4, and of the grooves 112 is not limited to three, and the number of the fuses 51, 52, of the fuse holders 6, and of the fuse-receiving portions 113 of the housing body 11 is not limited to two, and may vary depending on the number of the electrical cables 81, 82, 83 to be connected to the terminal block assembly 10.

It is worth mentioning that in actual use, the terminal block assembly 10 of the disclosure can prevent the light-emitting module 91 of the lamp 9 from damage of about 90% of surge incidents. The surge incidents are, for example, lighting strikes or power outages that result in a voltage spike which produces a corresponding increase in current to about 20 KA.

To sum up, since the surge protection device 2 is disposed in the accommodating space 111, and the first and second fuses 51, 52 are directly mounted to the block housing 1, space utilization of the outdoor lamp 9 is improved, and the outdoor lamp 9 may be designed to be relatively compact in size. Furthermore, since the cost of installing the surge protection device 2 is saved, the overall manufacturing cost of the outdoor lamp 9 is reduced.

Figure 5:
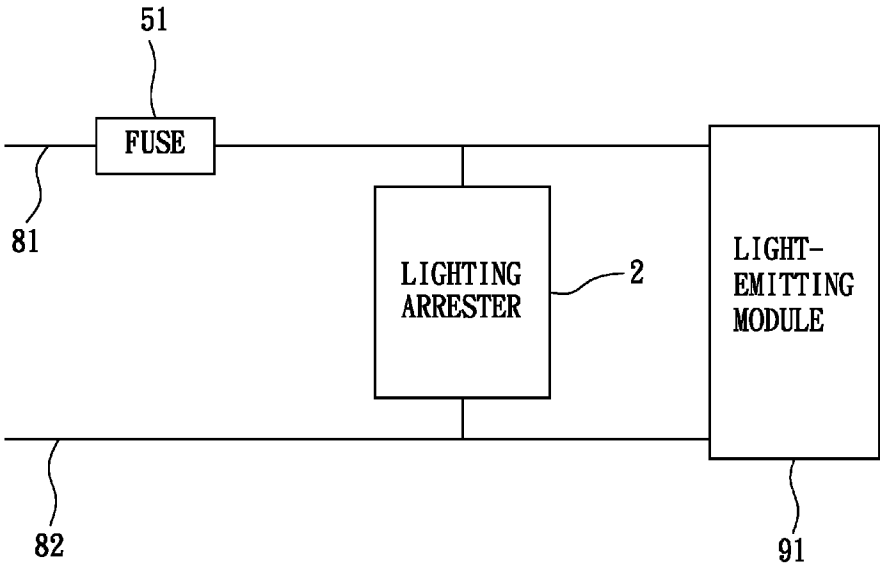
FIG. 5 is a schematic circuit block diagram illustrating a modification of the first exemplary embodiment, in which one of the fuses is omitted.
Figure 6:
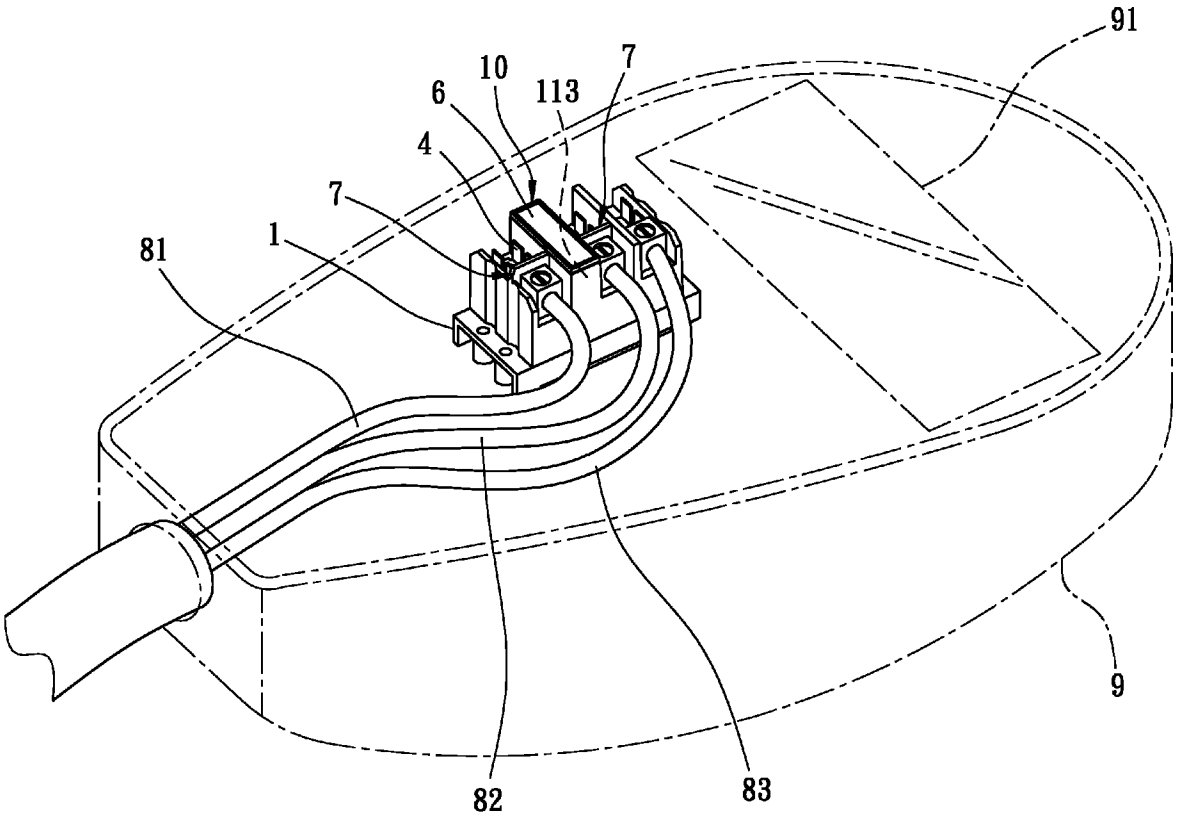
FIG. 6 is a fragmentary schematic view, illustrating the modification of the first exemplary embodiment being installed in the outdoor lamp and connected to the electrical cables.

Referring to FIGS. 5 and 6, in a modification of the first exemplary embodiment, the second fuse 52 is omitted. The terminal block assembly 10 includes only one fuse holder 6 on which the first fuse 51 is securely disposed, and one partition 7 that separates one of the cable-receiving seats 3, which receives the live line 81, and a corresponding one of the connector sets 4. The block housing 1 includes only one fuse-receiving portion 113 that engages the fuse holder 6. Such modification has the same size-reducing and cost-saving advantages as those of the exemplary embodiment.

Figure 7:
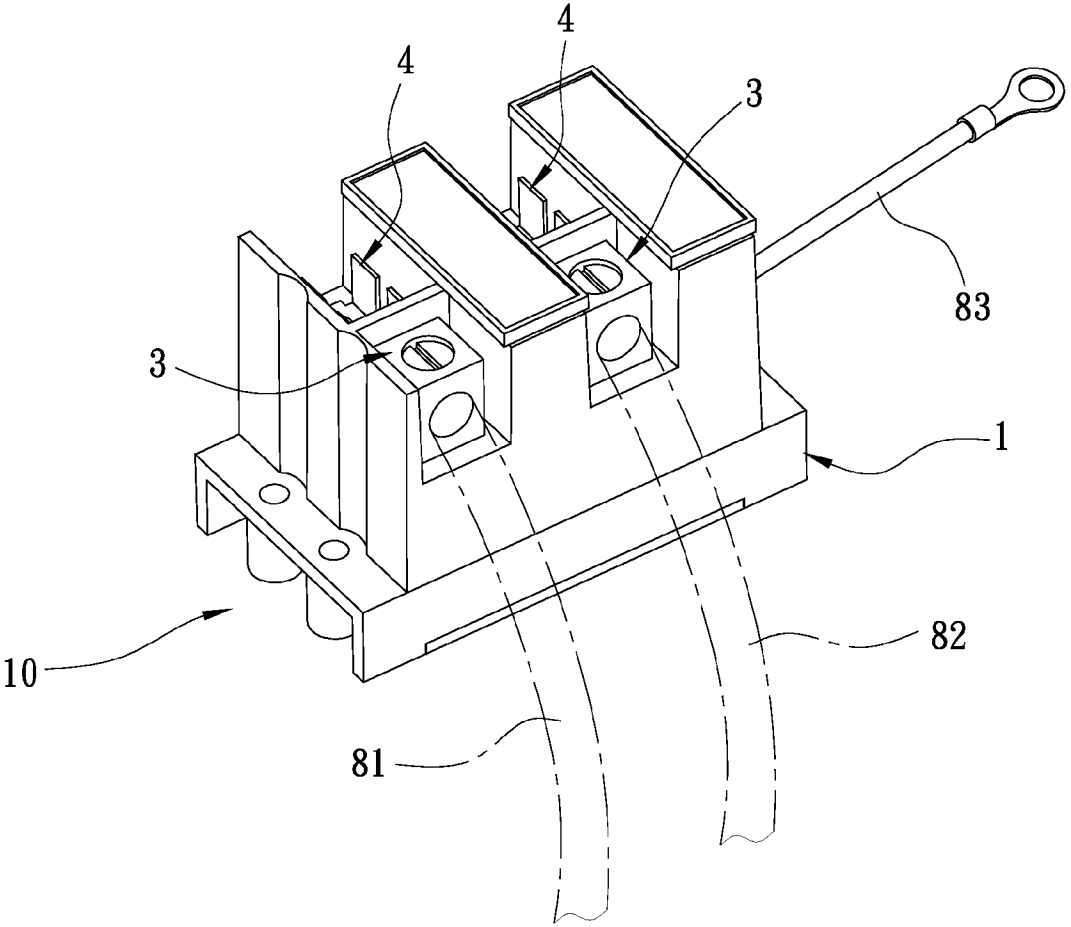
FIG. 7 is a perspective view illustrating a second exemplary embodiment of the terminal block assembly according to the disclosure.
Figure 8:
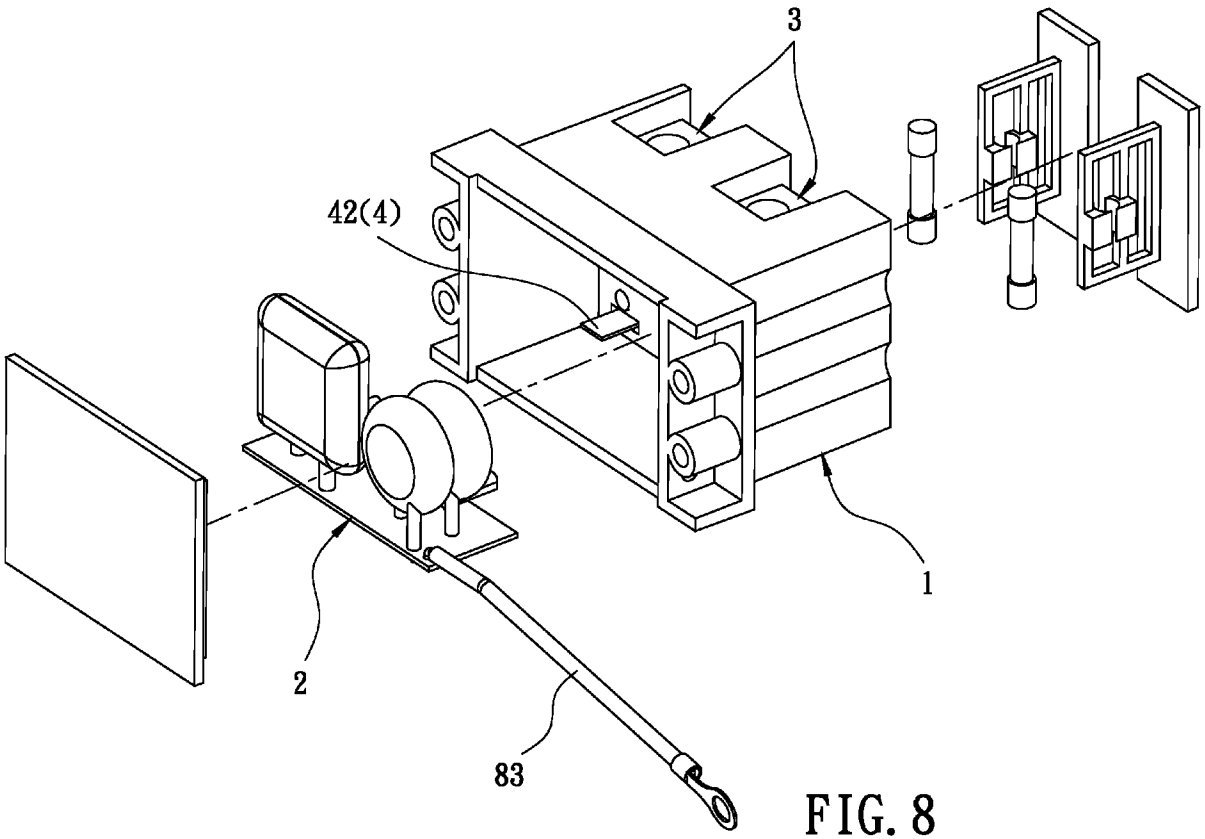
FIG. 8 is an exploded perspective view of the second exemplary embodiment.

Referring to FIGS. 7 and 8, a second exemplary embodiment of the terminal block assembly 10 according to the disclosure is similar to the first exemplary embodiment, the difference therebetween resides in that the terminal block assembly 10 of the second exemplary embodiment includes two of the cable-receiving seats 3 that are for respectively receiving the live line 81 and the neutral 82, and two of the connector sets 4 that correspond in position to the two cable-receiving seats 3, respectively. The terminal block assembly 10 of the second exemplary embodiment is provided with the ground 83 that is electrically connected to the surge protection device 2, that extends out of the block housing 1, and that is adapted to be directly connected to the lamp 9 (not shown).

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A terminal block assembly adapted for use in an outdoor lamp including a light-emitting module, and adapted to be connected to a plurality of electrical cables, said terminal block assembly comprising:

a block housing defining an accommodating space;

a surge protection device confined in said accommodating space;

a plurality of cable-receiving seats mounted to said block housing for receiving the electrical cables, respectively;

a plurality of connector sets mounted to said block housing, each of said connector sets including at least one first connector that is for electrical connection to the light-emitting module, and a second connector that extends into said accommodating space and that is electrically connected to said surge protection device; and a first fuse mounted to said block housing, and electrically connected to said surge protection device and a first selected one of the electrical cables.

2. The terminal block assembly of claim 1, wherein each of said cable-receiving seats is disposed adjacent to a respective one of said connector sets, said terminal block assembly further comprising a partition disposed between and separating one of said cable-receiving seats, which receives the first selected one of the electrical cables, and a corresponding one of said connector sets.

3. The terminal block assembly of claim 1, wherein:

said block housing is formed with a plurality of spaced-apart grooves, and has a fuse-receiving portion;

each of said grooves receives a respective one of said cable-receiving seats and a respective one of said connector sets therein; and said fuse-receiving portion permits said first fuse to be mounted thereto.

4. The terminal block assembly of claim 3, wherein said fuse-receiving portion is configured as a slot, said terminal block assembly further comprising a fuse holder which engages said fuse-receiving portion and on which said first fuse is securely disposed.

5. The terminal block assembly of claim 4, wherein said grooves and said fuse-receiving portion are formed in an outer surface of said block housing.

6. The terminal block assembly of claim 5, wherein said partition is disposed in one of said grooves which corresponds in position to the first selected one of the electrical cables.

7. The terminal block assembly of claim 1, further comprises a second fuse mounted to said block housing, and electrically connected to said surge protection device and a second selected one of the electrical cables.

8. The terminal block assembly of claim 7, wherein each of said cable-receiving seats is disposed adjacent to a respective one of said connector sets, said terminal block assembly further comprising a plurality of partitions, each of which being disposed between and separating a corresponding one of said cable-receiving seats and a corresponding one of said connector sets.

9. The terminal block assembly of claim 8, wherein said block housing is formed with a plurality of spaced-apart grooves, and has two fuse-receiving portions;

each of said grooves receives a respective one of said cable-receiving seats and a respective one of said connector sets therein; and said fuse-receiving portions permit said first and second fuses to be respectively mounted thereto.

10. The terminal block assembly of claim 9, wherein said grooves are arranged alternately with said fuse-receiving portions.

11. The terminal block assembly of claim 9, wherein each of said fuse-receiving portions is configured as a slot, said terminal block assembly further comprising two fuse holders which respectively engage said fuse-receiving portions and on which said first and second fuses are respectively and securely disposed.

12. The terminal block assembly of claim 11, wherein said grooves and said fuse-receiving portions are formed in an outer surface of said block housing.

13. The terminal block assembly of claim 11, wherein said partitions are respectively disposed in selected ones of said grooves which correspond in position to the first and second selected ones of the electrical cables, respectively.

14. The terminal block assembly of claim 1, wherein said block housing includes a housing body and a cover board, said cover board and said housing body cooperatively defining said accommodating space, and being sealed together so as to prevent water vapor from entering into said accommodating space.

15. The terminal block assembly of claim 1, wherein said surge protection device includes at least one metal oxide varistor.

16. The terminal block assembly of claim 1, wherein a maximum current rating of said first fuse includes 10 amperes.

* * * * *